US005894766A

United States Patent [19]

Yang

[11] Patent Number: 5,894,766

[45] Date of Patent: Apr. 20, 1999

[54] RATCHET SCREWDRIVER

[76] Inventor: Chung-Jeng Yang, 58, Ma Yuan West St., Taichung, Taiwan

[21] Appl. No.: 09/058,455

[22] Filed: Apr. 10, 1998

[51] Int. Cl.[6] ..... B25B 13/46

[52] U.S. Cl. ..... 81/60; 81/64

[58] Field of Search ..... 81/60, 64, 450, 81/177.6, 177.75

[56] References Cited

U.S. PATENT DOCUMENTS 1,624,530 4/1927 Caruso ..... 81/450

2,406,952 9/1946 Jesepho ..... 81/450

*Primary Examiner*—Timothy V. Eley

*Assistant Examiner*—Sinclair Skinner

[57] ABSTRACT

A ratchet screwdriver has a handle portion, a connection rod connected to the handle portion, a joint sleeve disposed on the connection rod, a circular hole in the joint sleeve, a first volute spring disposed in the circular hole, a chuck sleeve having a hexagonal blind hole and a round hole, and a bit inserted in the hexagonal blind hole. A rotating device has a first end inserted in the circular hole and a second end inserted in the round hole. A compression spring encloses the rotating device. A first C-shaped clamp retainer encloses the joint sleeve. A second C-shaped clamp retainer encloses a first distal portion of the chuck sleeve. A third C-shaped clamp retainer encloses a second distal portion of the chuck sleeve. A second volute spring is disposed in the round hole.

4 Claims, 4 Drawing Sheets

RATCHET SCREWDRIVER

BACKGROUND OF THE INVENTION

The present invention relates to a ratchet screwdriver. More particularly, the present invention relates to a ratchet screwdriver which has a universal joint device to be bent whenever it is necessary.

A conventional ratchet screwdriver does not have any rotatable front portion. Therefore, the conventional ratchet screwdriver should approach a screw perpendicularly.

SUMMARY OF THE INVENTION

An object of the present invention is to provide a ratchet screwdriver which has a universal joint device to be bent whenever it is necessary.

Accordingly, a ratchet screwdriver comprises a handle portion, a connection rod connected to the handle portion, a joint sleeve disposed on an end of the connection rod, a circular hole formed in the joint sleeve, a first volute spring disposed in the circular hole, a chuck sleeve having a hexagonal blind hole and a round hole, and a bit inserted in the hexagonal blind hole. A rotating device has a first end inserted in the circular hole and a second end inserted in the round hole. A compression spring encloses the rotating device. The compression spring is disposed between the joint sleeve and the chuck sleeve. A first C-shaped clamp retainer encloses the joint sleeve. A second C-shaped clamp retainer encloses a first distal portion of the chuck sleeve. A third C-shaped clamp retainer encloses a second distal portion of the chuck sleeve. A second volute spring is disposed in the round hole.

In accordance with a first preferred embodiment of the present invention, a ratchet screwdriver comprises a handle portion, a hexagonal recess hole formed on an end of the handle portion, a connection rod connected to the handle portion, a joint sleeve disposed on an end of the connection rod, a through hole formed on the joint sleeve, a circular hole formed in the joint sleeve, a first volute spring disposed in the circular hole, a chuck sleeve having a hexagonal blind hole, a round hole, and a through aperture, and a bit inserted in the hexagonal blind hole. A rotating device has a first end inserted in the circular hole and a second end inserted in the round hole. A compression spring encloses the rotating device. The compression spring is disposed between the joint sleeve and the chuck sleeve. A first C-shaped clamp retainer encloses the joint sleeve. A second C-shaped clamp retainer encloses a first distal portion of the chuck sleeve. A third C-shaped clamp retainer encloses a second distal portion of the chuck sleeve. A second volute spring is disposed in the round hole. The rotating device has a first plate and a second plate. Each of the first and the second plates has two opposite ends and two oblong holes. A first pin passes through the through hole and the respective oblong holes. A second pin passes through the through aperture and the respective oblong holes.

In accordance with a second preferred embodiment of the present invention, a ratchet screwdriver comprises a handle portion, a connection rod connected to the handle portion, a joint sleeve disposed on an end of the connection rod, a circular hole formed in the joint sleeve, a first volute spring disposed in the circular hole, a chuck sleeve having a hexagonal blind hole and a round hole, and a bit inserted in the hexagonal blind hole. A rotating shaft has a first end inserted in the circular hole and a second end inserted in the round hole. A compression spring encloses the rotating shaft. The compression spring is disposed between the joint sleeve and the chuck sleeve. A first C-shaped clamp retainer encloses the joint sleeve. A second C-shaped clamp retainer encloses a first distal portion of the chuck sleeve. A third C-shaped clamp retainer encloses a second distal portion of the chuck sleeve. A second volute spring is disposed in the round hole.

DETAILED DESCRIPTION OF THE INVENTION

Figure 1:
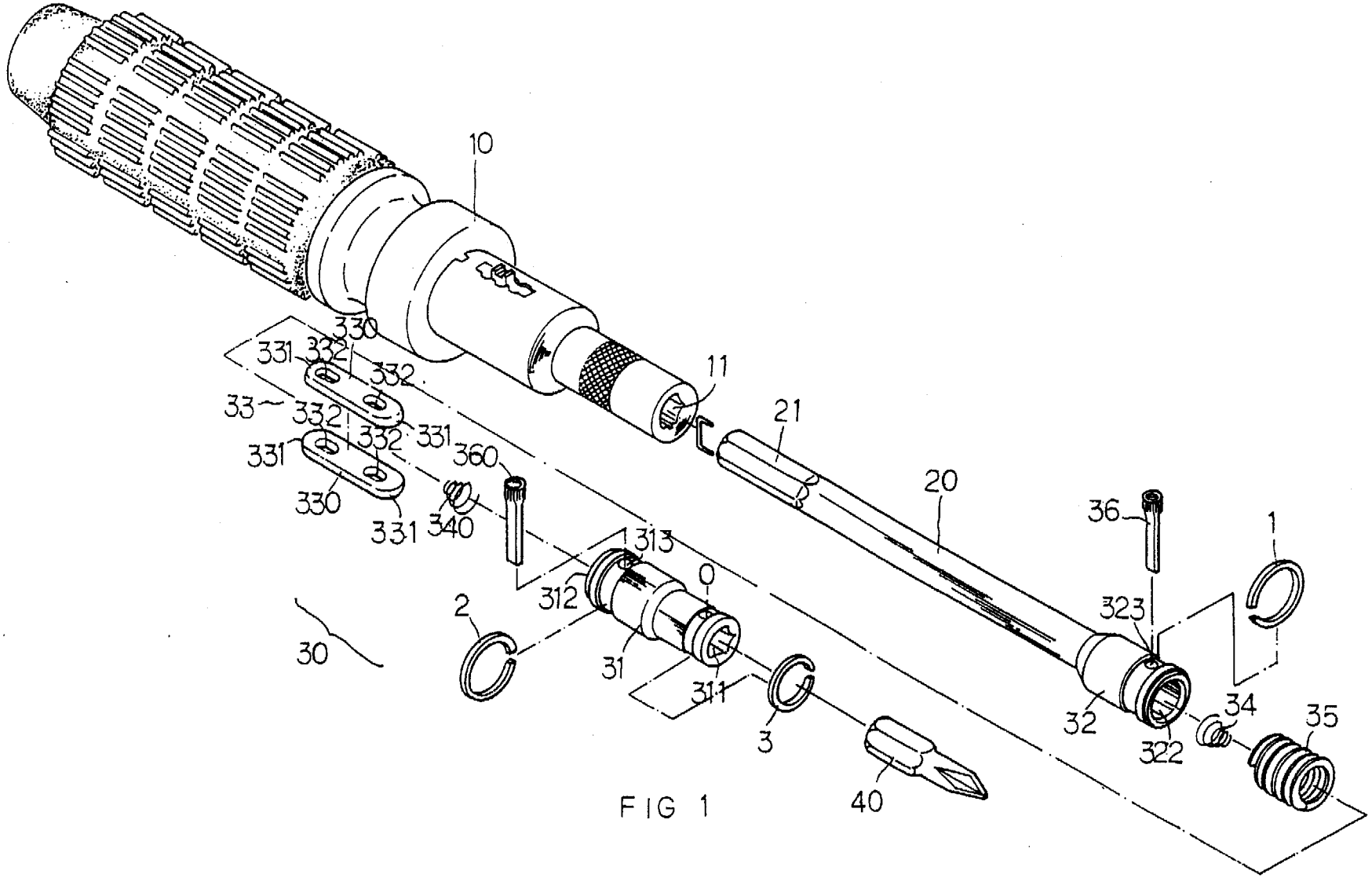
FIG. 1 is a perspective exploded view of a ratchet screwdriver of a preferred embodiment in accordance with the present invention.
Figure 2:
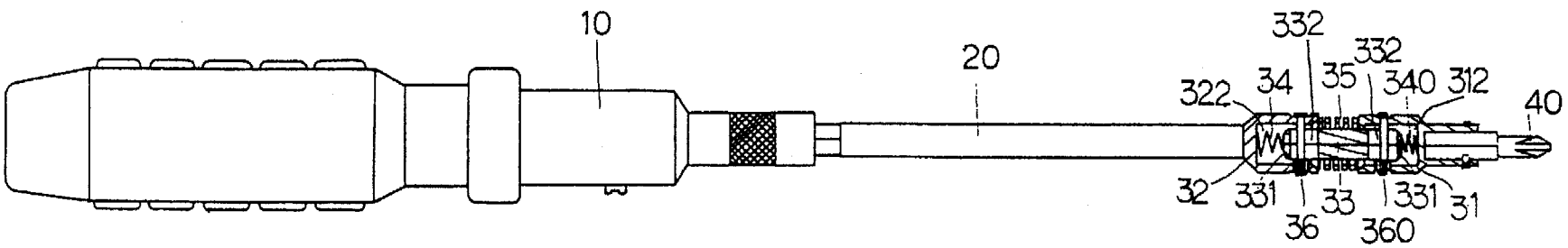
FIG. 2 is a sectional assembly view of a ratchet screwdriver of a preferred embodiment in accordance with the present invention.
Figure 3:
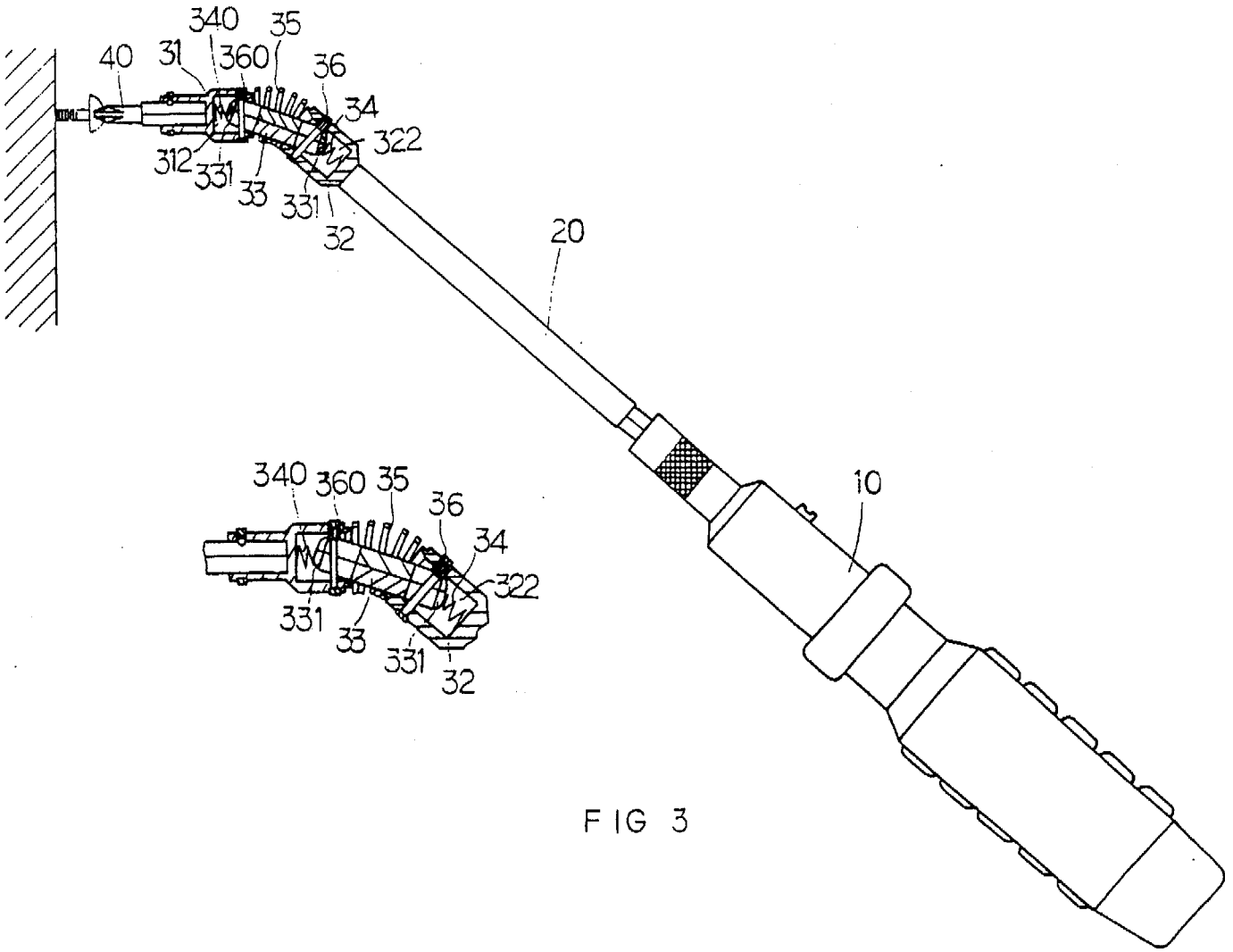
FIG. 3 is an elevational view of a ratchet screwdriver of a preferred embodiment in accordance with the present invention.

Referring to FIGS. 1 to 3, a first ratchet screwdriver comprises a handle portion 10, a hexagonal recess hole 11 formed on an end of the handle portion 10, a connection rod 20 connected to the handle portion 10, a joint sleeve 32 disposed on an end of the connection rod 20, a through hole 323 formed on the joint sleeve 32, a circular hole 322 formed in the joint sleeve 32, a first volute spring 34 disposed in the circular hole 322, a chuck sleeve 31 having a hexagonal blind hole 311, a round hole 312, and a through aperture 313, and a bit 40 inserted in the hexagonal blind hole 311. A rotating device 33 has a first end inserted in the circular hole 322 and a second end inserted in the round hole 312. A compression spring 35 encloses the rotating device 33. The compression spring 35 is disposed between the joint sleeve 32 and the chuck sleeve 31. A first C-shaped clamp retainer 1 encloses the joint sleeve 32. A second C-shaped clamp retainer 2 encloses a first distal portion of the chuck sleeve 31. A third C-shaped clamp retainer 3 encloses a second distal portion of the chuck sleeve 31. A second volute spring 340 is disposed in the round hole 312.

The rotating device 33 has a first plate 330 and a second plate 330. Each of the first and the second plates 330 has two opposite ends 331 and two oblong holes 332. A first pin 36 passes through the through hole 323 and the respective oblong holes 332. A second pin 360 passes through the through aperture 313 and the respective oblong holes 332.

The connection rod 20 has a hexagonal end 21 inserted in the hexagonal recess hole 11.

The assembly of the joint sleeve 32, the chuck sleeve 31, the rotating device 33, and the compression spring 35 is called a universal joint sleeve 30. The universal joint sleeve 30 can be bent whenever it is necessary.

Figure 4:
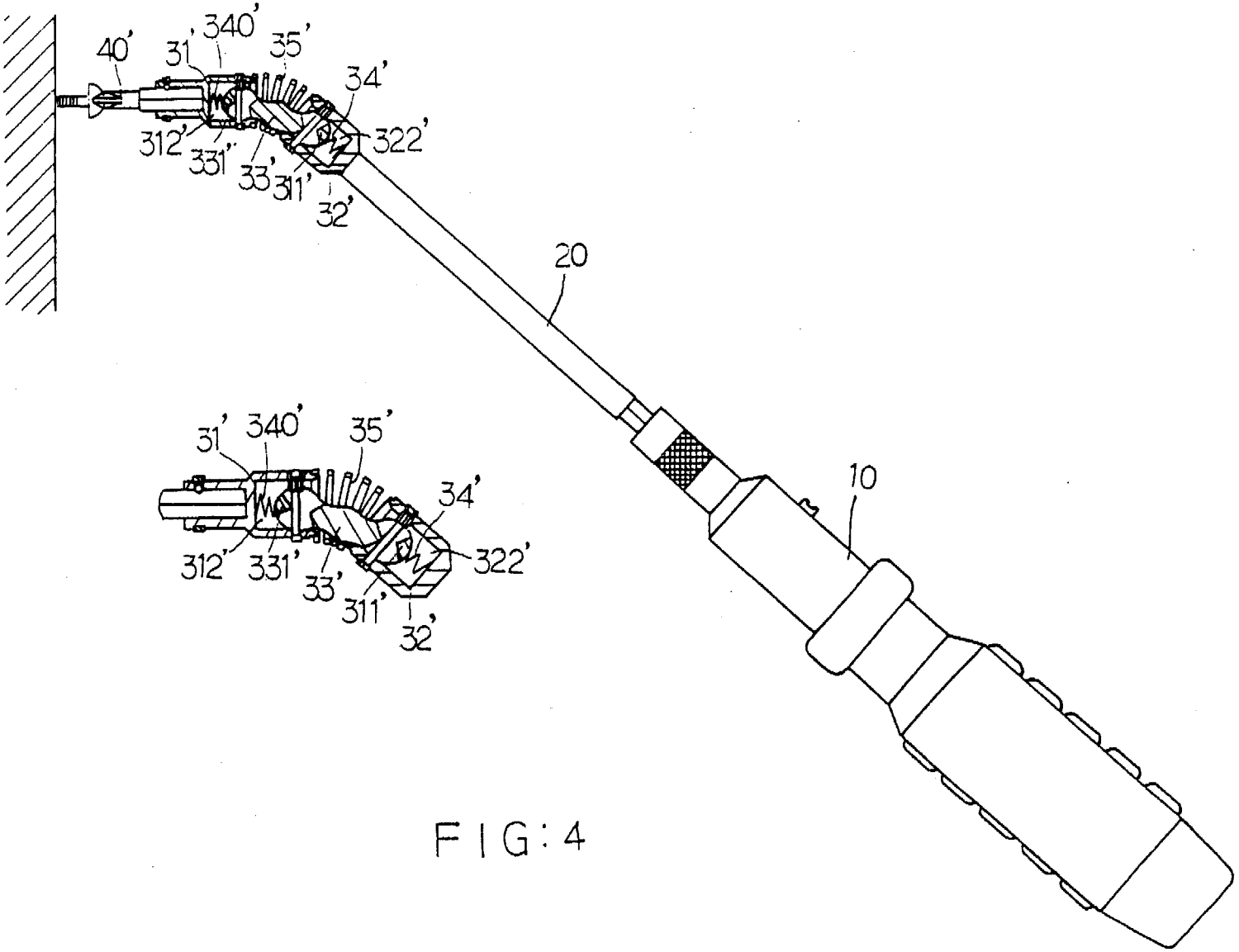
FIG. 4 is an elevational view of a ratchet screwdriver of another preferred embodiment in accordance with the present invention.

Referring to FIG. 4, a second ratchet screwdriver comprises a handle portion 10', a connection rod 20' connected to the handle portion 10', a joint sleeve 32' disposed on an end of the connection rod 20', a circular hole 322' formed in the joint sleeve 32', a first volute spring 34' disposed in the circular hole 322', a chuck sleeve 31' having a hexagonal blind hole 311' and a round hole 312', and a bit 40' inserted in the hexagonal blind hole 311'. A rotating shaft 33' has a first end inserted in the circular hole 322' and a second end inserted in the round hole 312'. A compression spring 35' encloses the rotating shaft 33'. The compression spring 35' is disposed between the joint sleeve 32' and the chuck sleeve 31'. A first C-shaped clamp retainer (not shown in the figure) encloses the joint sleeve 32'. A second C-shaped clamp retainer (not shown in the figure) encloses a first distal portion of the chuck sleeve 31'. A third C-shaped clamp retainer (not shown in the figure) encloses a second distal portion of the chuck sleeve 31'. A second volute spring 340' is disposed in the round hole 312'.

The invention is not limited to the above embodiment but various modification thereof may be made. Further, various changes in form and detail may be made without departing from the scope of the invention.

I claim:

1. A ratchet screwdriver comprises:

a handle portion, a connection rod connected to the handle portion, a joint sleeve disposed on an end of the connection rod, a circular hole formed in the joint sleeve, a first volute spring disposed in the circular hole, a chuck sleeve having a hexagonal blind hole and a round hole, a bit inserted in the hexagonal blind hole, a rotating device having a first end inserted in the circular hole and a second end inserted in the round hole, a compression spring enclosing the rotating device, the compression spring disposed between the joint sleeve and the chuck sleeve, a first C-shaped clamp retainer enclosing the joint sleeve, a second C-shaped clamp retainer enclosing a first distal portion of the chuck sleeve, a third C-shaped clamp retainer enclosing a second distal portion of the chuck sleeve, and a second volute spring disposed in the round hole.

2. A ratchet screwdriver as claimed in claim 1, wherein the connection rod has a hexagonal end inserted in the hexagonal recess hole.

3. A ratchet screwdriver as claimed in claim 1, wherein the rotating device is a shaft.

4. A ratchet screwdriver as claimed in claim 1, wherein the rotating device has a first and a second plates, and each of the first and the second plates has two opposite ends and two oblong holes.

* * * * *